US005229688A

United States Patent [19]

Branston et al.

[11] Patent Number: 5,229,688

[45] Date of Patent: Jul. 20, 1993

[54] METHOD OF OPERATING A GAS DISCHARGE SWITCH AND AN ARRANGEMENT FOR CARRYING OUT THE METHOD

[75] Inventors: David W. Branston, Igelsdorf; Robert Seeböck, Bubenreuth, both of Fed. Rep. of Germany

[73] Assignee: Siemens Aktiengesellschaft, Munich, Fed. Rep. of Germany

[21] Appl. No.: 741,478

[22] PCT Filed: Oct. 17, 1989

[86] PCT No.: PCT/EP89/01237

§ 371 Date: Aug. 9, 1991

§ 102(e) Date: Aug. 9, 1991

[87] PCT Pub. No.: WO90/09673

PCT Pub. Date: Aug. 23, 1990

[30] Foreign Application Priority Data

Feb. 10, 1989 [DE] Fed. Rep. of Germany ..... 39040131

[51] Int. Cl.[5] ..... H01J 17/00; H01J 17/48

[52] U.S. Cl. ..... 313/590; 313/589; 313/619; 361/129

[58] Field of Search ..... 313/589, 590, 605, 606, 313/619; 361/129

[56] References Cited

U.S. PATENT DOCUMENTS 3,241,903 3/1966 Bergan ..... 316/24
4,939,416 7/1990 Seeboeck et al. ..... 313/590
5,075,592 12/1991 Seeboeck et al. ..... 313/590

FOREIGN PATENT DOCUMENTS 0337192 10/1989 European Pat. Off. .
3721529 1/1989 Fed. Rep. of Germany .
0868448 5/1961 United Kingdom .

OTHER PUBLICATIONS

Soviet Physics, Technical Physics, vol. 21, No. 4, Apr. 1976, American Institute of Physics, V. K. Bocharov: "Hydrogen Generators for Sealed Switches" pp. 487–489.

Proc. IEE, vol. 111, No. 1, Jan. 1964, pp. 203–213, R. Hancox: "Low-Pressure Gas Discharge Switches for Use in Fusion Experiments".

J. Phys. E: Sci. Instr., vol. 19, 1986, Great Britain, The Institute of Physics, pp. 466–470: "High Repetition Rate, Fast Current Rise, Pseudo-Spark Switch".

*Primary Examiner*—Sandra L. O'Shea
*Attorney, Agent, or Firm*—Kenyon & Kenyon

[57] ABSTRACT

The invention relates to a gas discharge switch with a low-pressure gas discharge segment, which is provided with an anode and at least one main cathode, and arranged in an ionizable working gas. It is provided with a control unit for flow discharge, which contains a cathode. For the working gas, a gas storage with automatic pressure control is provided. According to the invention, the energy of glow discharge is provided as the setting value for regulating the pressure of the working gas. With this module (30), consisting of the cathode (31) for glow discharge with the gas storage (32), the pressure of the working gas, preferably hydrogen, remains at least approximately constant over a long period of time, in a closed system of this so-called pseudo-spark switch.

22 Claims, 2 Drawing Sheets

METHOD OF OPERATING A GAS DISCHARGE SWITCH AND AN ARRANGEMENT FOR CARRYING OUT THE METHOD

BACKGROUND OF THE INVENTION

The present invention relates to a gas discharge switch and more particularly to such a switch with a low-pressure gas discharge segment which is provided with an anode and at least one main cathode and arranged in an ionizable working gas and to which a control device which contains a cathode is assigned.

The ignition voltage for a predetermined gas discharge segment and its usual graphic representation as a function of the product of the gas pressure p and the electrode distance D in the ignition characteristic curve is known to be formed by taking the ignition probability, an important aid in characterizing electric discharge apparatus, into consideration. In the determination of the electric voltage resistance of the preset gas discharge segment, an infinitely large plate capacitor and its ignition characteristic curve are generally used for a comparison. However, the practical embodiment of such discharge segments has electrodes with finite dimensions. While it is sufficient, in order to determine the right branch of the ignition characteristic curve known as the Paschen curve (i.e., in order to study the so-called far breakdown zone, including the voltage minimum), merely to arrange two flat, rounded-off plates, possibly provided with a so-called Rogowski profile at the edges, parallel to one another, such a design arrangement is not usable to study ignition characteristic lines in the left part of the Paschen curve, i.e., in the so-called post breakdown zone, because then indirect charges can occur. Such indirect discharges can be avoided with an electrode design with flat plate electrodes which are arranged coaxial to one another, and are bent away from one another at their edges, with a small radius of curvature relative to the electrode distance, and guided along the inside cylindrical insulator surface. In this way, a gap is always formed between the bent-away, cylinder-shaped edge zone of the electrodes and the inside wall of the hollow cylinder insulator. Such embodiments of low-pressure gas discharge segments are also suitable for the near breakdown zone.

Low-pressure gas discharge segments are known to be suitable as switches for high currents, for example of about 50 kA to 2 MA, and high voltages up to about 100 kV. These gas discharge switches work with a pressure of the working gas, preferably hydrogen, of less than 1 torr at an electrode gap of less than 1 cm, with a voltage about 10 kV in the left branch of the Paschen curve. Since these switches can only turn a current on, but not off again, they are particularly suited for discharging large capacitors, for example at a voltage of 10 to 100 Kv and currents up to 10 MA, at which several switches are then generally switched in parallel. The discharge switch contains an anode and a main cathode, which are arranged coaxial to one another and are separated at the edge by a ring-shaped insulator (Proc. IEE, Volume 111, Number 1, January 1964, pages 203 to 213).

Such gas discharge switches can be controlled by a pulsed low-pressure gas discharge. The main discharge is initiated by a hollow cathode discharge and ignited by injection of charge carriers. For this purpose, a control device is provided, which contains a cage provided with holes, which surrounds the rear space of the cathode. The discharge segment is separated from the zone of a preionization discharge, which is a flow discharge, by the cage. Between the cage and the zone of the glow discharge, various auxiliary electrodes for shielding and potential control can also be provided as disclosed in Sci. Instr. 19 (1986), The Inst. of Physics, Great Britain, pages 466 to 470.

In this closed system, the pressure of the working gas decreases with an increasing number of switching processes. The reason for this lies in the implantation of charged high-energy particles during the discharge. In order to counteract this, the gas discharge system can be provided with a gas storage for the working gas, which can consist of a metal suitable as a storage or reservoir, for example titanium, zirconium, tantalum, palladium or even lanthane. Furthermore, intermetallic cubic Laves phases, which consist of a compound of iron hydride with one of the rare earth elements are suitable as storage material. This storage material absorbs gas, at a raised temperature, in an atmosphere enriched with the working gas, and this gas is stored in the lattice. In a vacuum or in the working gas of a gas discharge switch, it gives the working gas off again when heated.

To regulate the working gas to a constant pressure, a gas storage with an automatic pressure control can be provided. A known embodiment of such a gas storage consists of two generators, one of which serves as a storage and the other of which serves as a getter. The generator gives off gas when heated, for example by a heating coil, and the storage absorbs gas if too much gas is released and therefore a pressure increase occurs. The distance between the storage metal and the generator sheath is selected so it is not greater than the mean free path length of the working gas, i.e., at most approximately 0.4 mm for hydrogen as disclosed in Sov. Phys. Tech. Phys. Volume 21, Number 4, April 1976, pages 487 to 489.

SUMMARY OF THE INVENTION

The present invention is based on the task of simplifying and improving a gas discharge switch with a low-pressure gas discharge segment and an integrated glow discharge segment as the trigger part, and the pressure control for the working gas, in particular, is supposed to be simplified.

This task is accomplished, according to the present invention which provides a gas discharge switch with a low-pressure gas discharge segment that has an anode and at least one main cathode. The segment is arranged in a working gas and a control device for glow discharge is assigned to the segment. In this embodiment of a gas discharge switch, the energy of the glow discharge is provided as the setting value for control of the pressure of the working gas, which can preferably consist of hydrogen.

In a preferred embodiment of the gas discharge switch, the gas storage can be integrated into the cathode of the glow discharge. This cathode can preferably consist of a stack of ring disks, which are connected with each other with thermal conductivity, and consist of a material which serves as storage for the working gas. The distance of the plates relative to one another is then preferably selected to be less than the mean free path length of the working gas.

Furthermore, storage material can also be provided in powder form, and placed against the cathode to form a good heat-conducting connection. A further advantageous possibility is the implementation of the storage in the form of a paste or a sintered element containing the storage material.

BRIEF DESCRIPTION OF THE DRAWINGS

For a further explanation of the invention, reference is made to the drawings.

DETAILED DESCRIPTION

Figure 1:
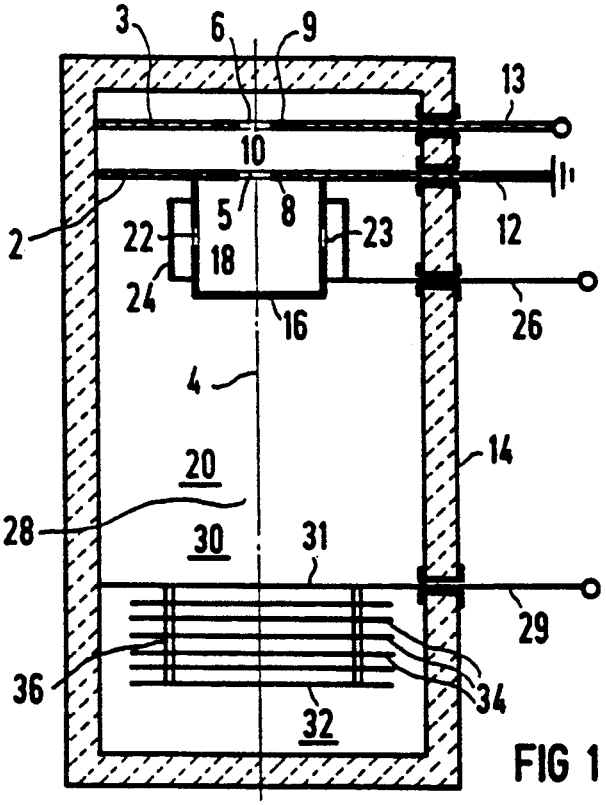
FIG. 1 schematically illustrates a cross-section through a gas discharge switch with automatic pressure control of the working gas.

In the embodiment of a gas discharge switch according to the present invention illustrated in FIG. 1, two electrodes 2 and 3, of which the electrode 2, for example, is switched as the main cathode and the electrode 3 is switched as an anode, and which each form a rotation element, are arranged coaxially to one another. The axis of rotation, indicated with a dot-dash line, is designated as 4. The electrodes 2 and 3 are provided with coaxial bores 5 and 6, respectively, at which a gas discharge segment 10 is formed. The electrodes 2 and 3 consist of an electrically conductive material, for example special steel, and, at the discharge segment 10, can preferably include inserts 8 and 9, respectively, of a metal which melts at high temperature, for example, tungsten or molybdenum, or their alloys. The diameter of the bores 5 and 7 is selected to be preferably less than the distance between the electrodes 2 and 3. The electrical current leads to the main cathode 2 and the anode 3 are designated as 12 and 13, respectively, in the figure. In general, the main cathode 2 will lie at zero potential or ground and a positive potential of about 20 kV, for example, will be applied to the anode. The current leads 12 and 13 are passed vacuum-sealed through a housing 14, which preferably can consist of a ceramic.

Below the discharge segment 10 there is a control device 20 with a housing 16, which surrounds a rear cathode space 18. The housing 16 is provided with openings 22 and 23, which are shielded by a hollow cylinder trigger electrode. This trigger electrode 24 is provided with a control connection 26, which is passed vacuum-sealed through the housing 14. The housing 14 furthermore contains a module 30 consisting of a cathode 31 for glow discharge and a gas storage element 32 for the working gas, preferably hydrogen or deuterium, or a gas mixture containing these gases. The cathode 31 for glow discharge, the connection conductor 29 of which is also passed vacuum-sealed through the housing 14, form a discharge space 28 for the glow discharge, together with the cylindrical side wall of the housing 14 and the housing 16 for the rear cathode space. The gas storage element 32 can include, for example, a stack of sheets 34 of storage material, which are connected with the cathode 31 to provide good heat conductivity, via spacers 36. The distance between the sheets 34, which can comprise, for example, titanium or zirconium, is preferably selected to be at most as great as the mean free path length of the working gas, i.e., about 0.3 to 0.4 mm for hydrogen as the working gas.

Due to the operating conditions, especially the current at the cathode 31, a glow discharge is set, which burns in the discharge space 28, anomalously and impeded, at the same time. In an anomalous glow discharge, the available surface of the cathode 31 is completely covered by the discharge. Since the burning voltage of the discharge is dependent on the quotient of the current density j and the square of the gas pressure p, a reduction in the gas pressure p results in an increase in the burning voltage. In the case of impeded discharge, the distance between the anode 3 and the cathode 31 is not sufficient for an undisturbed formation of the negative flow light; in an extreme case, the anode 3 dips into the cathode drop space. With an increasing degree of impedance, the burning voltage of the discharge increases. The degree of impedance can be estimated from the rule known for normal glow discharge, that the product of the length of the cathode dark space d and the gas pressure p is constant. If the distance between the anode 3 and the cathode 31 is reduced until it is significantly less than $2\times d$ then the discharge is impeded and the burning voltage will increase. If the pressure is increased in the case of a glow discharge which is already burning in impeded manner, a corresponding reduction of the burning voltage will occur. In a gas discharge switch with a low-pressure gas discharge segment, the burning voltage of the glow discharge is therefore influenced by the pressure. If the pressure drops, the burning voltage will increase, and vice versa.

An increase in the burning voltage also means a corresponding increase in the output absorbed by the cathode 31, with a corresponding increase in the temperature. In the module 30 consisting of the cathode 31 and the gas storage 32, hydrogen is released from the storage 32 if the temperature of the cathode 31 increases, and the original decrease in pressure is compensated for.

To initiate the glow discharge, a negative voltage, which can amount to $-2.5$ kV, for example, is applied to the cathode 31. In contrast, a trigger voltage is provided for the trigger electrode 24, which can amount to $+50$ V and $-50$ V, switchable, for example. It is also practical if the cathode 31 is provided with a coating, not shown in the figure, which consists of a metal with a low sputter yield, for example of molybdenum or nickel.

Figure 2:
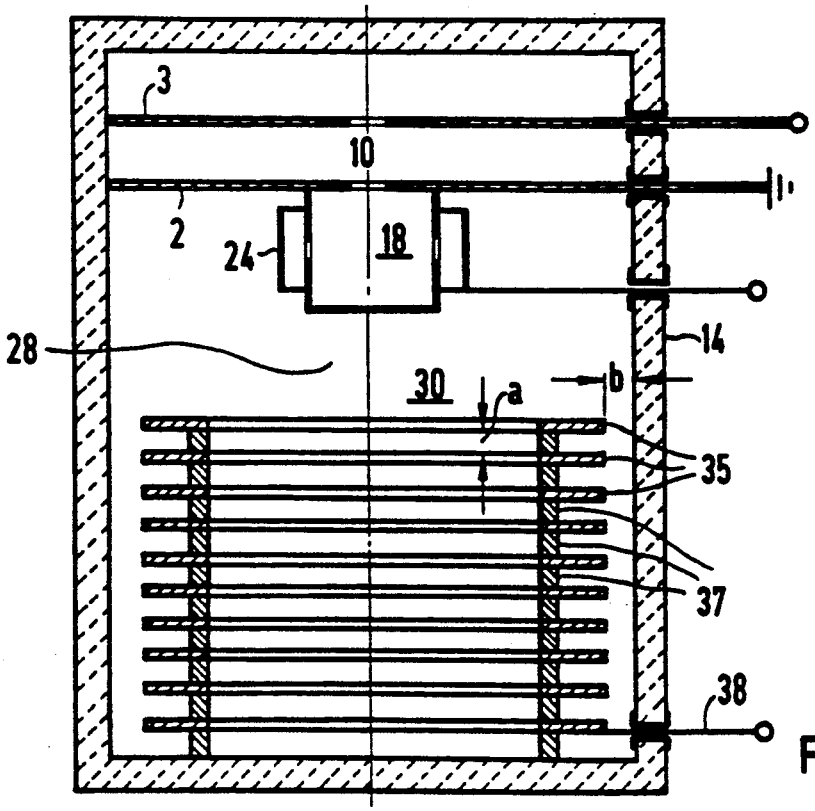
FIG. 2 shows a preferred embodiment of the gas discharge switch.

In the embodiment according to FIG. 2, with the same arrangement of the main cathode 2 and the anode 3, as well as the gas discharge segment 10 and the rear cathode space 18 with the trigger electrode 24, a module 30 consisting of a hollow cylinder cathode and a gas storage is provided, which includes a stack of ring-shaped sheets 35 of storage material, which are arranged in a stack with spacers 37 of an electrically and thermally conductive material, especially storage material, with this stack partially surrounding the discharge space 28. The distance "a" between the individual storage sheets 35 and their distance b from the inside wall of the housing 14 is selected in such a way that it is not significantly greater, and preferably less, than the median free path length of the charge carriers of the working gas. At a gas pressure p of 20 Pa, for example, the median free path length of hydrogen is approximately 0.3 mm.

Under some circumstances, it can be practical to produce each of the ring-shaped storage sheets 35 with the adjacent spacers 37 according to FIG. 2 in one piece. Furthermore, it is possible that only the ring-disk-shaped storage sheets 35 consist of storage material and that those sheets are attached at the outside mantle surface of a hollow cylinder cathode 31, which then preferably consists of a material with a low sputter yield Likewise, the storage material can consist of a paste which is applied for example, to the outside mantle surface of a ring-cylinder cathode.

Figure 3:
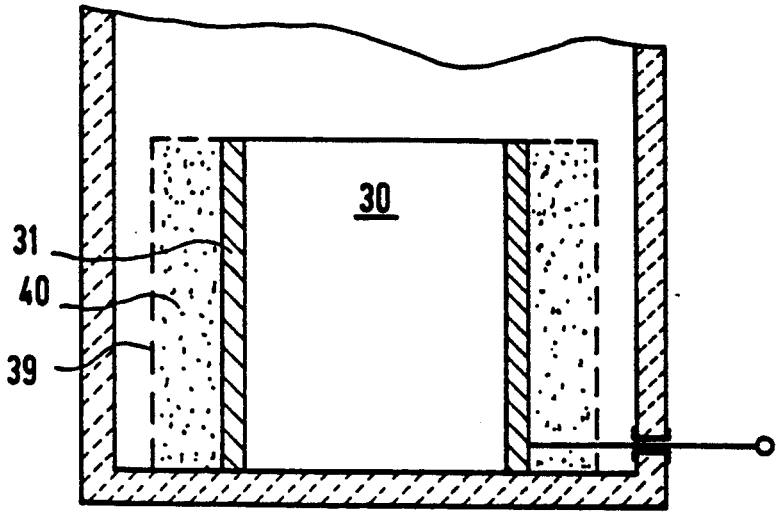
FIG. 3 shows a special embodiment of the gas storage element.

At greater pressures and correspondingly lesser free path lengths of the charge carriers, in particular, it can be practical to apply the storage material 40 according to FIG. 3 in powder form, between the hollow cylinder cathode 31 and a container 39 of gas-permeable material, which can consist, for example, of a metallic lattice or network or also of porous ceramic.

In an embodiment of the module 30 consisting of the cathode 31 and the gas storage, in which the storage material 40 consists of a sintered element which is connected with the cathode 31 to conduct heat well, a special container 39 is not required. In this embodiment, the inside surface of the ring cylinder sintered element consisting of the storage material 40 can preferably serve as the cathode 31.

What is claimed is:

1. In a gas discharge switch, an arrangement comprising:

a low-pressure gas discharge section comprising an anode, at least one main cathode;

an auxiliary cathode;

a working gas with a gas reservoir;

a glow discharge section wherein a glow discharge is maintained on an auxiliary cathode; and a thermally conductive connected between said auxiliary cathode and said gas reservoir, said thermally conductive connector setting the energy of the glow discharge as a control value for regulating the pressure of said working gas.

2. The arrangement according to claim 1, wherein said working gas is selected from a group including hydrogen, deuterium or a gas mixture containing these gases.

3. The arrangement of claim 1 wherein the reservoir in integrated into the cathode for glow discharge.

4. The arrangement according to claim 1, wherein said thermally connector includes a stack of ring-disk-shaped storage sheets which are connected to one another to be thermally conductive.

5. The arrangement of claim 4, wherein a distance between said storage sheets and an inside wall of a housing is less than the mean free path length of the charge carrier of the working gas.

6. The arrangement of claim 1 wherein said auxiliary includes a ring-cylinder cathode for glow discharge, said connection including a plurality of ring-disk-shaped storage sheets which are attached to an outside mantle of said ring-cylinder cathode.

7. The arrangement of claim 6, wherein a distance between the storage sheets is less than the mesh free path length of a charge carrier of the working gas.

8. The arrangement of claim 1, further comprising storage material in powder form and connected with the auxiliary cathode for glow discharge to conduct heat.

9. The arrangement of claim 1, wherein storage material in said gas reservoir is arranged in a gas-permeable container.

10. The arrangement of claim 1, wherein the gas reservoir comprises a paste which is applied to a mantle surface of said auxiliary cathode which comprises a hollow cylinder cathode for glow discharge.

11. The arrangement of claim 1, wherein the gas reservoir comprises a hollow cylinder sintered element, an inside mantle surface of which forms the auxiliary cathode for glow discharge.

12. In a method of operating a gas discharge switch having an anode a main cathode which together form a low pressure gas discharge section, and a control device for a glow discharge which contains an auxiliary cathode and has a gas reservoir for a working gas, regulating the pressure of the working gas as a function of the energy of the glow discharge using a thermally conductive connection between said gas reservoir and said auxiliary cathode.

13. The arrangement as claimed in claim 12, wherein the working gas is selected from the group including hydrogen, deuterium, and a gas mixture containing these gases.

14. The arrangement as claimed in claim 12, wherein the gas reservoir is integrated in the cathode.

15. The arrangement as claimed in claim 14, having a constructional unit consisting of the cathode and the gas reservoir, which consists of a stack of reservoir sheets shaped liked annular disks, which are mutually connected by said thermally conducting conductor.

16. The arrangement as claimed in claim 14, wherein the reservoir comprises a plurality of reservoir sheets shaped like annular disks which are mounted on the outer surface of an annular cylindrical cathode.

17. The arrangement as claimed in claim 15 wherein a mutual spacing of the reservoir sheet is smaller than a mean free path length $\lambda$ of the charge carriers of the working gas.

18. The arrangement as claimed in claim 15, wherein a spacing (b) of the reservoir sheets from an inner wall of the housing is smaller than a mean free path length $\lambda$ of the charge carriers of the working gas.

19. The arrangement as claimed in claim 18, wherein the reservoir material is arranged in a container previous to gas.

20. The arrangement as claimed in claim 12, wherein the gas reservoir contains a reservoir material in powder form which is connected to the cathode in a fashion which conducts heat effectively.

21. The arrangement as claimed in claim 12, wherein the gas reservoir consists of a paste which is applied to one of the lateral surfaces of a hollow cylindrical cathode.

22. The arrangement as claimed in claim 12, wherein the gas reservoir consists of a hollow cylindrical sintered body whose inner lateral surface forms the cathode.

* * * * *